US011084678B2

(12) United States Patent
Picchi et al.

(10) Patent No.: US 11,084,678 B2
(45) Date of Patent: Aug. 10, 2021

(54) REWINDING MACHINE AND RELATIVE METHOD FOR REWINDING AND FORMING A ROLL OF PAPER

(71) Applicant: GAMBINI S.p.A., Milan (IT)

(72) Inventors: Fabio Picchi, Lammari (IT); Giovanni Buffa, Ponte Buggianese (IT)

(73) Assignee: GAMBINI S.P.A., Milan (IT)

( * ) Notice: Subject to any disclaimer, the term of this patent is extended or adjusted under 35 U.S.C. 154(b) by 260 days.

(21) Appl. No.: 16/225,590

(22) Filed: Dec. 19, 2018

(65) Prior Publication Data

US 2019/0193974 A1 Jun. 27, 2019

(30) Foreign Application Priority Data

Dec. 22, 2017 (IT) ..... 102017000148730

(51) Int. Cl.
*B65H 19/22* (2006.01)
*B65H 18/20* (2006.01)
*B65H 18/28* (2006.01)

(52) U.S. Cl.
CPC ..... *B65H 19/2269* (2013.01); *B65H 18/20* (2013.01); *B65H 18/28* (2013.01);
(Continued)

(58) Field of Classification Search
CPC ..... B65H 19/2269; B65H 2408/235; B65H 2301/4172; B65H 2301/41468;
(Continued)

(56) References Cited

U.S. PATENT DOCUMENTS 4,783,015 A 11/1988 Shimizu
5,769,352 A 6/1998 Biagiotti
(Continued)

FOREIGN PATENT DOCUMENTS

EP 3037372 A2 6/2016

OTHER PUBLICATIONS

European Search Report for corresponding application EP18212941; Report dated May 6, 2019.

*Primary Examiner* — Michael E Gallion
(74) *Attorney, Agent, or Firm* — Cantor Colburn LLP

(57) ABSTRACT

A rewinding machine and a related method, the machine including three rollers having axes parallel to one another and perpendicular to the advancing direction of the paper, where two lower and upper winding rollers collaborate with a third oscillable roller under pressure on a roll or log being formed identifying a winding area, where the paper being wound passes over the upper winding roller and the finished roll comes out from an outlet opening defined between the lower roller and the third roller, where the cores for the rolls are fed one after the other by a conveyor and inserted by a thruster in a channel formed beneath the upper roller, the lower and upper winding rollers being supported in rotation at the ends of their axes in a mobile manner and being associated with an actuator device for a translation in a direction parallel to a first straight line joining the axes of the lower and upper winding rollers and symmetrical with respect to a growth straight line of the roll, where the growth straight line of the roll is arranged perpendicular to the first straight line joining the two axes of the lower and upper winding rollers and equally spaced between them.

10 Claims, 3 Drawing Sheets

(52) U.S. Cl.
CPC ..... *B65H 2301/4172* (2013.01); *B65H 2408/235* (2013.01); *B65H 2515/12* (2013.01); *B65H 2555/10* (2013.01); *B65H 2701/1846* (2013.01)

(58) Field of Classification Search
CPC .... B65H 18/20; B65H 18/28; B65H 2515/12; B65H 2701/1846
See application file for complete search history.

(56) References Cited

U.S. PATENT DOCUMENTS

| | | | | |
|---|---|---|---|---|
| 7,942,363 | B2 * | 5/2011 | Gelli | B65H 19/2269 242/532.2 |
| 8,267,344 | B2 * | 9/2012 | Maddaleni | B65H 19/2269 242/532.1 |
| 9,327,932 | B2 * | 5/2016 | Mazzaccherini | B65H 19/2238 |
| 9,809,417 | B2 * | 11/2017 | Mellin | B65H 18/20 |
| 10,562,725 | B2 * | 2/2020 | Buffa | B65H 18/16 |
| 2004/0099761 | A1 * | 5/2004 | Recami | B65H 18/20 242/533.1 |
| 2006/0169733 | A1 * | 8/2006 | Perini | B65H 19/305 225/93 |
| 2009/0095836 | A1 | 4/2009 | Maddalini | |
| 2013/0221150 | A1 | 8/2013 | Morelli | |

* cited by examiner

REWINDING MACHINE AND RELATIVE METHOD FOR REWINDING AND FORMING A ROLL OF PAPER

CROSS REFERENCE TO RELATED APPLICATION

This application is related to and claims the benefit of Italian Patent Application Number 102017000148730 filed on Dec. 22, 2017, the contents of which are herein incorporated by reference in their entirety.

TECHNICAL FIELD

The present disclosure refers to a rewinding machine and to a relative method for rewinding and forming a roll of paper.

BACKGROUND

In peripheral winding rewinders there are three rollers having axes parallel to one another and perpendicular to the advancing direction of the paper, which is equipped with a series of transversal perforation and weakening lines spaced according to regular intervals along its longitudinal extension. Two winding rollers, lower and upper, are supported on the frame and collaborate in winding with a third oscillable roller, or press roller, which is kept under pressure on a roll being formed, the so-called log, identifying the winding area.

At the end of the winding of a log, in the so-called exchange step, it is necessary to interrupt the continuity of the paper being wound, partially returned onto the upper roller, to discharge the finished roll through an outlet opening defined between the lower roller and the third roller and start a new winding on a new fed core, provided with a longitudinal line of glue, in a channel formed between the upper roller and underlying curved elements, called cradles.

According to a first known type of rewinder, mechanical tearing means are associated on the upper roller according to different possible configurations, like for example the one shown in EP 1 262 434 A2, in which in the exchange step the paper is interrupted by the action of a stop element, or stopper, which intervenes against the upper winding roller to press the paper against it, in a position upstream with respect to the new core inserted in the cradles. The stopping of the paper against the upper roller causes the tensioning thereof downstream and the consequent tearing along a perforation.

In known rewinding machines the formed log comes out from the winding area in general through the effect of the deceleration of the lower winding roller.

Starting a new winding in the channel on a core provided with glue creates a so-called tail, in other words a portion of paper between the glue and the initial end of the paper, which constitute waste, not being useful for contributing to the length of the roll.

The core, during the winding of the first turns of paper, travels along the final part of the channel with a roto-translational motion and reaches the winding area passing between the upper winding roller and the lower winding roller with mechanical interference, in general of about a couple of millimetres, thanks to the thrusts generated by the deceleration of the lower roller during the discharging of the formed log.

As a result of this, the first turns of the log being wound, identifying for example about 3-4 mm of thickness of the paper wound on the core, are wound tighter with respect to the next ones wound.

The consumer's sensation of non-uniformity of the winding density, however, constitutes an indicator of lower quality of the product.

BRIEF SUMMARY

The disclosure provides a rewinding machine and a relative method for rewinding and forming a roll of paper that improves the uniformity of the winding density.

The disclosure further provides a rewinding machine and a relative method for rewinding and forming a roll of paper that is particularly simple and functional, with low costs.

Herein disclosed is a rewinding machine and a relative method for rewinding and forming a roll of paper that are particularly simple and functional.

BRIEF DESCRIPTION OF THE DRAWINGS

The characteristics and advantages of a rewinding machine and of a relative method for rewinding and forming a roll of paper according to the present disclosure will become clearer from the following description, given as a non-limiting example, referring to the attached schematic drawings, in which.

DETAILED DESCRIPTION

Figure 1:
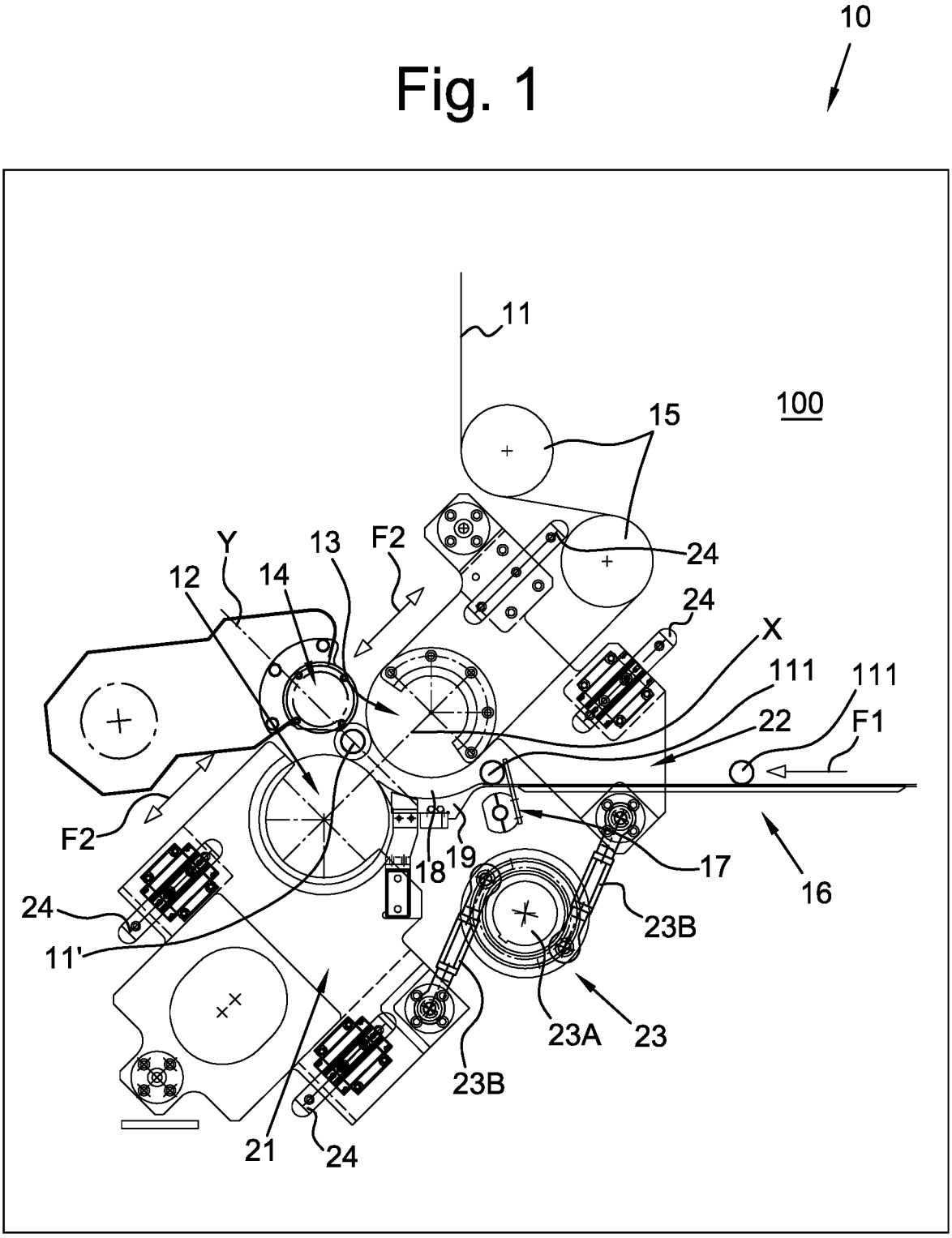
FIG. 1 is a schematic side section view of a rewinding machine according to the disclosure.
Figure 2A:
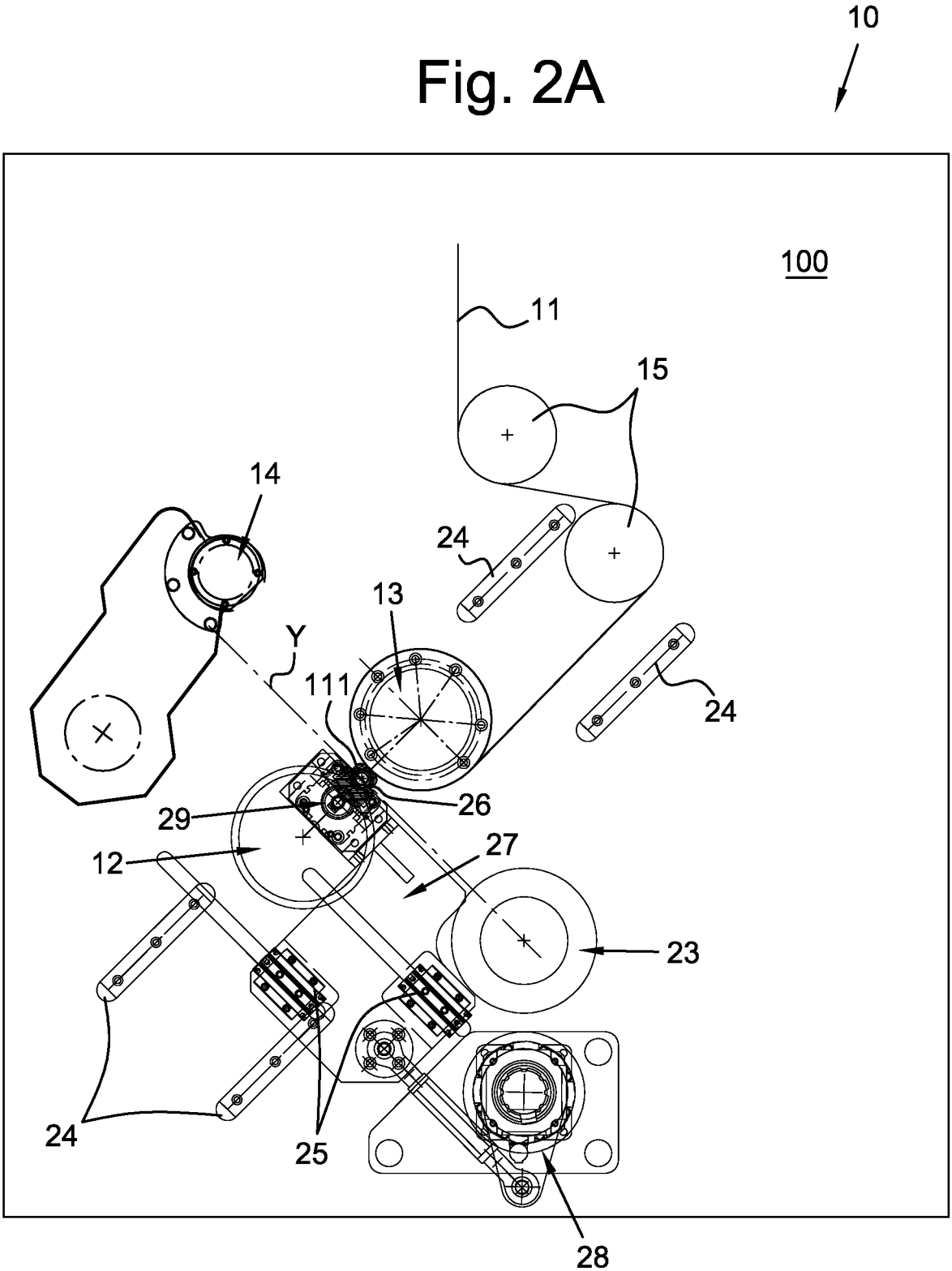
FIGS. 2A and 2B schematically show a detail of the machine of FIG. 1, comprising a group to aid the winding, with punches in start of winding position and with punches in end of winding position, respectively.
Figure 2B:
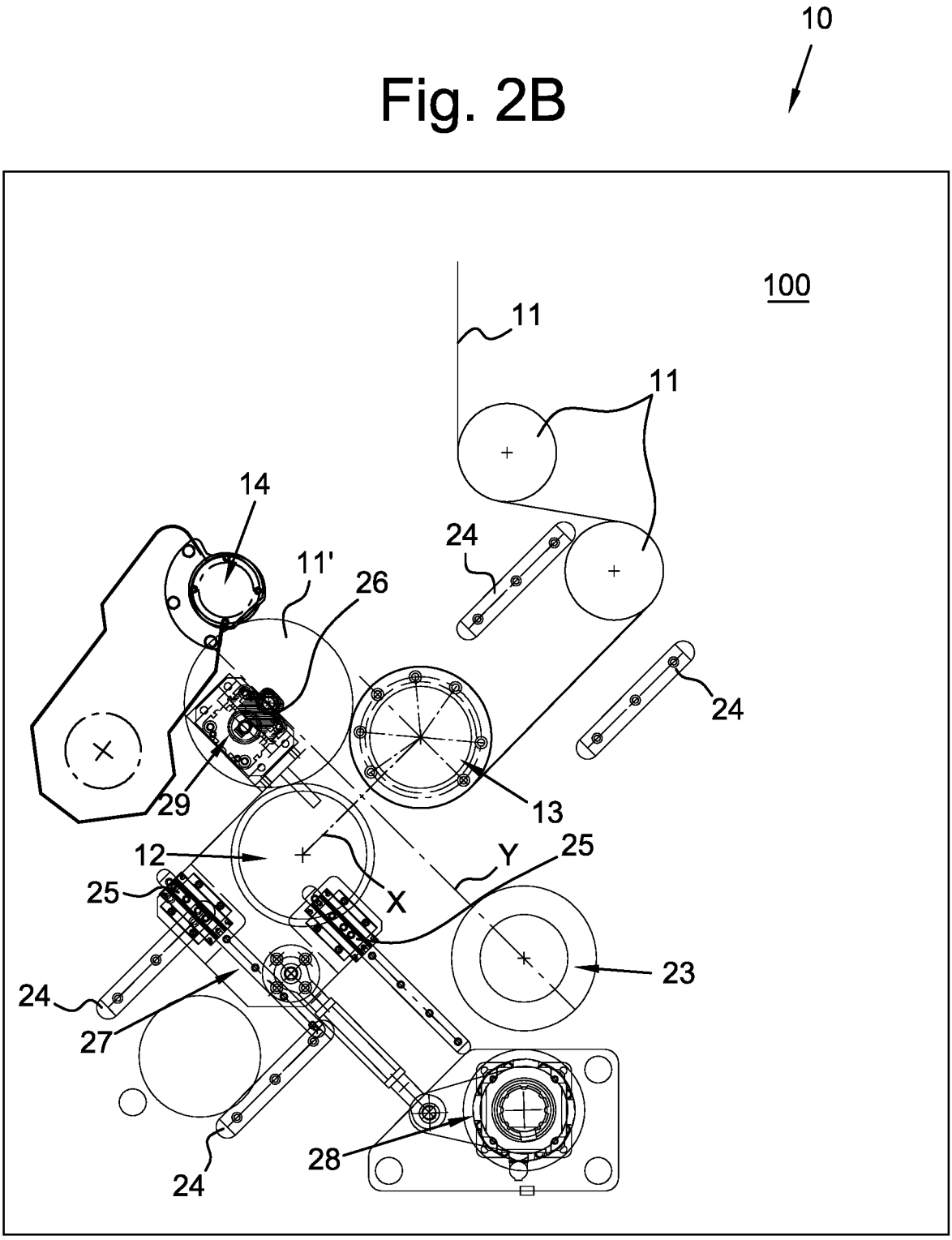

With reference to the figures, a rewinding machine for rewinding and forming a roll of paper 11', called log, is shown, wholly indicated with 10.

The rewinding machine 10 comprises three rollers having axes parallel to one another and perpendicular to the advancing direction of the paper 11, in which two lower and upper winding rollers 12, 13 collaborate with a third oscillable roller 14, called press roller, kept under pressure during winding on the roll 11' being formed, identifying a winding area 20.

The paper 11 being wound, equipped with a series of transversal perforation and weakening lines, spaced according to regular intervals along its longitudinal extension, is wound on the upper winding roller 13, possibly deviated by one or more idler rollers 15, arranged upstream of the upper winding roller 13.

Mechanical tearing means, not shown, can be associated according to any known method with the upper winding roller 13.

The cores 111 are fed one after the other, according to the direction identified in the figures with the arrow F1, in the example by a conveyor 16 and inserted by an oscillating thruster 17 in a channel 18 formed between the upper winding roller 13 and underlying curved elements 19, called cradles.

A gluing group, not shown, deposits glue, in general according to a straight line, on the core and/or on the paper 11 according to known methods.

After fixing through glue the paper 11 being wound on the core inserted in the channel 19, it passes between the lower and upper winding rollers 12, 13 to reach the winding area 20.

The finished roll 11', after the exchange step, comes out from an outlet opening defined between the lower winding roller 12 and the third roller 14, preferably facilitated by the deceleration of the lower winding roller 12. The term "exchange step" is meant to indicate the step in which the end of the winding of a roll 11' and the start of a new winding take place.

In the rewinding machine 10 according to the disclosure the lower and upper winding rollers 12, 13 are supported in rotation at the ends of their axes in a mobile manner with respect to a frame, comprising two opposite fixed sidewalls 100, and are associated with an actuator device 23 for a translation in a direction parallel to a first straight line X joining the axes of the lower and upper winding rollers 12, 13, and symmetrical with respect to a growth straight line Y of the roll 11', identified with the arrows F2 in FIG. 1.

In particular, according to the disclosure, the growth straight line Y of the roll 11' is arranged perpendicular to the first straight line X joining the two axes of the lower and upper winding rollers 12, 13 and equally spaced between them.

Preferably, the lower and upper winding rollers 12, 13 are supported by a lower mobile support 21 and an upper mobile support 22, in turn constrained to the frame 100 through pairs of rectilinear translation guides 23 having direction parallel to the straight line joining the axes of the lower and upper winding rollers 12, 13 and symmetrical arrangement with respect to the growth straight line Y of the roll 11'.

Alternatively, the lower and upper winding rollers 12, 13 can be supported by other equivalent means adapted for allowing the same symmetrical translation movement with respect to the growth straight line Y of the roll 11'.

Preferably, according to the disclosure, the connection between the mobile supports 21, 22 and the frame 100 is made through pairs of rectilinear translation guides 24 having direction parallel to the first straight line X joining the axes of the lower and upper winding rollers 12, 13 and symmetrical arrangement with respect to the growth straight line Y of the roll 11'.

Advantageously, the actuator device 23 is a single actuator common to both of the mobile supports 21, 22 and is connected to both the lower and upper mobile supports 21, 22.

According to an embodiment of the disclosure, shown as an example, the actuator device 23 comprises a motor 23A connected to the lower and upper mobile supports 21, 22 through a pair of tie rods 23B, respectively hinged at their opposite ends to the motor 23A itself and to one of the lower and upper mobile supports 21, 22.

According to a preferred embodiment of the machine 10, the moving group of the winding rollers 12 and 13, described above, is arranged on the outer side of the frame 100.

Advantageously, the rewinder according to the disclosure can comprise, close to the winding area 20, a group to aid the winding comprising at least one pair of linear guides 25 for supporting a pair of punches 26, also called "tutors" or "wind aids" to aid the winding, which are inserted in the opposite ends of the core 111 of the roll 11' being wound and support it during the winding step.

The at least one pair of linear guides 25 slidably engages, on opposite sidewalls of the frame 100, a pair of support plates 27, to which the pair of punches 26 is constrained.

The linear guides 25 for supporting the punches 26 are made fixed on the frame 100, preferably on the inner side thereof, in a direction parallel to the growth straight line Y of the roll 11', which in the rewinding machine according to the disclosure remains constant during the winding step and independent from the diameter of the core 111.

The linear movement of the pair of punches 26 along the growth straight line Y is controlled by an actuator 28, for example comprising a cam device, from a start of winding position engaged in the core arranged on the straight line intersecting the axes of the winding rollers 12, 13 and an end of winding position engaged in the core slightly before the formed roll 11' comes out from the winding area, and vice-versa.

Each punch forming the pair of punches 26 comprises a linear actuator 29 that controls the movement in a direction parallel to the axis of the core to engage the pair of punches inside the core and disengage it.

The machine 10 according to the disclosure, according to a preferred embodiment, comprises a group for adjusting the position of the cradles as the diameter of the core changes, not shown since it is known.

The method for rewinding and forming a roll of paper according to the disclosure provides for the steps of:

- spacing the upper and lower mobile rollers 12, 13 in a symmetrical manner with respect to a growth straight line Y of the roll 11' to facilitate the passage of the core 111 from the channel 18 formed beneath the upper winding roller 13 to the winding area 20 in the exchange step;
- bringing the mobile upper and lower winding rollers 12, 13 symmetrically closer towards the growth straight line Y of the roll 11' until it is placed at a predetermined distance for performing the winding step of the roll;
- winding the roll 11' according to the growth straight line Y, which remains constant during the winding.

Advantageously, according to a preferred embodiment of the disclosure, during the winding of the roll 11' the core 111 is supported through the insertion at its opposite ends of a pair of punches 26 to aid the winding, mobile along the growth straight line Y by means of fixed linear guides 25. The punch 26, which comprises a piston 29 that carries a truncated cone at the tip for insertion in the core 111 during the winding of the roll and that rotates, in general idle, in interference in the core 111, helps the uniform winding of the paper 11 on the core 111, which behaves in a substantially similar way to a winding on a spindle, in particular for the consumer line, and avoids the lateral displacement of the core 111 in the case of rolls 11' of large diameters like for the industrial line.

It has been described that to carry out the adjustment of the change of diameter of the core 111 to be wound before starting the machine 10, the adjustment of the distance between the lower and upper winding rollers 12, 13 is carried out by moving the rollers 12, 13 in opposite directions parallel to the straight line X joining the centres of the two rollers 12, 13. This advantageously makes it possible to avoid adjustment to the group for aiding the winding comprising the punches. Indeed, whatever the diameter of the core 111 that is used, the movement of the pair of punches 26 will always be on the same growth straight line Y, which will remain fixed irrespective of the format of the core 111.

The rewinding machine 100 and the relative method for rewinding and forming a roll of paper of the present disclosure have the advantage of improving the phenomenon of the first turns wound tighter than the next ones and the consequent non-homogeneity of the winding density of the roll 11', thanks to the opening of the two winding rollers as the core passes between them.

Moreover, the punch advantageously contributes to a uniform winding on the core, supporting the weight of the roll 11' being wound.

Advantageously, with the rewinding machine and the relative method for rewinding and forming a roll of paper the winding is facilitated both in the initial steps and in the winding area making the quality result of the peripheral winding look like a spindle winding.

The rewinding machine and the relative method for rewinding and forming a roll of paper thus conceived can undergo numerous modifications and variants, all of which are within the scope of the disclosure; moreover, all of the details can be replaced by technically equivalent elements. In practice, the materials used, as well as the dimensions, can be whatever according to the technical requirements.

The invention claimed is:

1. Rewinding machine comprising three rollers having axes parallel to one another and perpendicular to the advancing direction of a paper, wherein two rollers comprise a lower winding roller and an upper winding roller that collaborate with a third oscillable roller under pressure on a roll or log being formed, identifying a winding area, the paper being wound passing over the upper winding roller and a finished roll coming out from an outlet opening defined between the lower roller and the third roller, the cores for said rolls being fed one after the other by a conveyor and inserted by a thruster in a channel formed below the upper roller, wherein said lower and upper winding rollers are supported in rotation at the ends of their axes in a mobile manner and are associated with an actuator device for a translation in a direction parallel to a first straight line joining the axes of the lower and upper winding rollers and symmetrical with respect to a growth straight line of the roll, wherein said growth straight line of the roll is arranged perpendicular to the first straight line joining the two axes of the lower and upper winding rollers and equally spaced between them.

2. Rewinding machine according to claim 1, wherein said lower and upper winding rollers are supported in rotation at the ends of their axes, respectively, by a lower mobile support and an upper mobile support, said lower and upper mobile supports being constrained to the frame through means adapted for allowing said translation in a direction parallel to the first straight line joining the axes of the lower and upper winding rollers and symmetrical with respect to the growth straight line of the roll.

3. Rewinding machine according to claim 2, wherein said connection means between the mobile supports and the frame are pairs of rectilinear translation guides having direction parallel to the first straight line joining the axes of the lower and upper winding rollers and symmetrical arrangement with respect to the growth straight line of the roll.

4. Rewinding machine according to claim 2, wherein said lower mobile support and upper mobile support are connected to said actuator device.

5. Rewinding machine according to claim 4, wherein said actuator device is a single actuator common to both said lower mobile support and upper mobile support.

6. Rewinding machine according to claim 5, wherein said actuator device comprises a motor connected to said lower and upper mobile supports through a pair of tie rods respectively hinged at their opposite ends to the motor and to one of said lower and upper mobile supports.

7. Rewinding machine according to claim 1, further comprising a pair of linear guides for supporting a pair of punches to aid the winding that insert in the opposite ends of the core of the roll being wound and support the core during the winding step, said pair of punches being guided in translation along the growth straight line of the roll.

8. Method for rewinding and forming a roll of paper in a machine according to claim 1, comprising:

spacing the mobile lower and upper winding rollers in a symmetrical manner with respect to a growth straight line of the roll to facilitate, in the exchange step, the passage of the core from the channel formed below the upper winding roller to the winding area;

bringing the lower and upper winding rollers symmetrically closer with respect to said growth straight line of the roll at a predetermined distance for performing the winding step of the roll;

winding the roll according to said growth straight line, which remains constant during the winding.

9. Method according to claim 8, wherein the core is supported during the winding step through the insertion at its ends of a pair of punches to aid the winding, said punches being mobile along the growth straight line by means of fixed linear guides.

10. Method according to claim 8, wherein said predetermined distance between the lower and upper winding rollers for performing the winding step of the roll can be set before starting the machine to carry out the adjustment of the diameter of the core, said adjustment being carried out in a symmetrical manner with respect to said growth straight line of the roll, said growth straight line of the roll being fixed, said growth straight line being the same for every adjustment of the distance between the lower and upper winding rollers.

* * * * *